US005213330A

United States Patent [19]

Benson

[11] Patent Number: 5,213,330

[45] Date of Patent: May 25, 1993

[54] GOLF COURSE, GOLF BALLS AND METHOD OF PLAY

[76] Inventor: D. Lorne Benson, Suite 204 - 40120 Willow Crescent, Squamish B.C., Canada, V0N 3G0

[21] Appl. No.: 831,659

[22] Filed: Feb. 7, 1992

Related U.S. Application Data

[63] Continuation of Ser. No. 550,907, Jul. 11, 1990, abandoned.

[51] Int. Cl.[5] ..... A63B 67/02

[52] U.S. Cl. ..... 273/176 A; 273/176 AB

[58] Field of Search ..... 273/176 R, 176 A, 176 AB, 273/176 G, 213, 233

[56] References Cited

U.S. PATENT DOCUMENTS

| | | | |
|---|---|---|---|
| 2,701,140 | 2/1955 | Fortino | 273/176 A |
| 3,464,703 | 9/1969 | Vallas | 273/181 R |
| 3,685,832 | 8/1972 | Johnson | 273/176 A |
| 3,708,173 | 1/1973 | Hewson, Jr. | 273/176 A |
| 3,904,209 | 9/1975 | Thomas | 273/176 A |
| 4,063,738 | 12/1977 | Michalson | 273/176 A |
| 4,145,053 | 3/1979 | Healey | 273/176 A |
| 4,157,831 | 6/1979 | Renn | 273/176 AB |
| 4,413,827 | 11/1983 | Aberg | 273/176 AB |
| 4,577,867 | 3/1986 | Lenhart | 273/176 AB |
| 4,872,686 | 10/1989 | Trasko | 273/176 AB |

OTHER PUBLICATIONS

*The Golf Course: Planning, Design, Construction & Maintenance;* Hawtree, F. W.; University Press, 1983; p. 63.

*Primary Examiner*—V. Millin
*Assistant Examiner*—Steven B. Wong
*Attorney, Agent, or Firm*—John J. Leavitt; Douglas R. Hanscom

[57] ABSTRACT

Presented is a golf course having a single fairway of conventional length common to at least three putting greens and cups, the course having a Tee area designated for use in connection with the three putting greens and cups, and a set of balls that are color coded in correlation to the green to which they are to be played. The Tee area is also delineated to provided specific areas from which golf balls are driven to the various greens, these areas also bearing indicia correlated to the green to which golf balls are to be played. In addition to being color coded, the balls are also marked with indicia indicating the sequence in which they are to be hit, and indicia indicating the golfer to which the balls belong. The course, the set of golf balls, and the method of play thus permit the completion of nine or eighteen holes of golf in a short time span in comparison to conventional golf courses.

10 Claims, 3 Drawing Sheets

ARCHIE

LORNE

GOLF COURSE, GOLF BALLS AND METHOD OF PLAY

This application is a continuation of application Ser. No. 07/550,907, filed Jul. 11, 1990, now abandoned.

BACKGROUND OF THE INVENTION

1. Field of the Invention

This invention relates to golf courses, and particularly to a golf course, golf balls and a method of playing the golf course that enables playing a complete round of golf within a compressed time span but on a course having a regulation length fairway.

2. Description of the Prior Art

A preliminary patentability and novelty search relating to the invention described and claimed herein has revealed the existence of six U.S. patents as follows:

| | | |
|---|---|---|
| 3,464,703 | 3,904,209 | 4,063,738 |
| 4,157,831 | 4,577,867 | 4,413,827 |

Referring to the prior art patents listed above, U.S. Pat. No. 3,464,703, as understood, relates to a golf course categorized as a "non-walking" course which nevertheless provides simulated putting "greens" at conventionally spaced distances so that a simulated game of golf may be played by the golfer without ever leaving the protected and enclosed Tee area. The simulated greens constitute shallow basins filled with water so that when a golf ball lands in the simulated "green" it obviously will not roll. Now, the golfer, theorizing that he has reached the "green", which is of course simulated, merely walks a few paces within the encloser to a real putting green and completes his play to that hole. This prior art patent is in sharp contrast to the golf course described herein which requires that the golfer drive to an actual green and then walk to the green (or ride a golf cart to the green) to complete his play to the cup associated with that green.

U.S. Pat. No. 3,904,209 also relates to a compact golf course providing multiple "holes" to shoot for from multiple "chutes" which have the effect of limiting the golfer's view point to the hole he is shooting for so that he is not distracted by a view of other holes to which other golfers might be shooting. This compact golf course is also categorized as a "non-walking" course and there is provided a moat to discourage players from walking on the fairways.

U.S. Pat. No. 4,063,738 is similar to U.S. Pat. No. 3,904,209 in some respects, but is different structurally and incorporates a different mode of playing the game of golf. However, it does provide a very compact course on which either nine or eighteen holes of golf may be played in a relatively short time. As with the two previous patents, it is not intended that golf players enter upon the fairway in this course.

U.S. Pat. No. 4,157,831 also relates to a compact golf course, but the arrangement is considerably different from the invention described and claimed herein.

U.S. Pat. No. 4,413,827 is categorized as a "scaled-down" golf course game. Implicit in this golf course game is the use of special variously colored "golf balls" that because of their design, cannot be driven as far as a conventional golf ball. This characteristic enables the use of much shorter fairways than would normally be the case. When the golfer reaches the putting green with his special "golf ball", he must then switch to a conventional golf ball to complete his play on the green.

U.S. Pat. No. 4,577,867 also relates to a golf game and golf course structure in which a short-flight, specially designed golf ball is utilized to enable the use of a very short fairway. This patent and the one previously discussed are significantly different in structure and mode of operation in that in the invention described and claimed herein regulation equipment is used to play on conventional length fairways and conventional putting greens, but played by a method that compresses only the time factor for playing a round of golf.

Accordingly, it is one of the objects of the invention herein to provide a golfer with the opportunity to play a round of golf out-of-doors, utilizing regulation equipment on a conventional fairway and putting green arrangement, but in a manner that enables playing a round of golf in a compressed time interval.

Another object of the invention is the provision of multiple sets of golf balls carrying indicia to indicate ownership and variously colored to correlate with the hole being played.

Still another object of the invention is the provision of a golf course construction designed to enable the playing of nine or eighteen holes of golf in a compressed time interval, and which may be closely juxtaposed to similar additional courses, all within a substantially compressed overall area, so that multiple sets of golfers may play golf on adjoining courses within a compressed time interval and without interference with each other.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the golf course, golf ball and method of play forming the subject matter of this invention comprises a generally elongated land area landscaped to provide a common fairway with multiple putting greens, and a Tee-area common to the fairway and greens, and golf ball sets variously colored to correlate to a particular green to which a golfer is shooting, and bearing indicia indicating ownership of the ball. Each course is designed so as to enable juxtaposition of multiple courses to accommodate multiple groups of golfers playing the multiple courses simultaneously without interfering with each other.

DESCRIPTION OF THE PREFERRED EMBODIMENT

In terms of greater detail, my invention described and claimed herein comprises at least three aspects, including a golf course per se that may be used for rapid play of nine or eighteen holes of golf, multiple sets of golf balls, with each ball marked with indicia to indicate the owner thereof, and the balls of the different sets having different colors to correlate the different colored balls with a selected fairway and greens. Each course according to my invention is designed to cooperate with additional similar courses to provide the opportunity for many groups of golfers to play simultaneously without interfering with each other.

Figure 1:
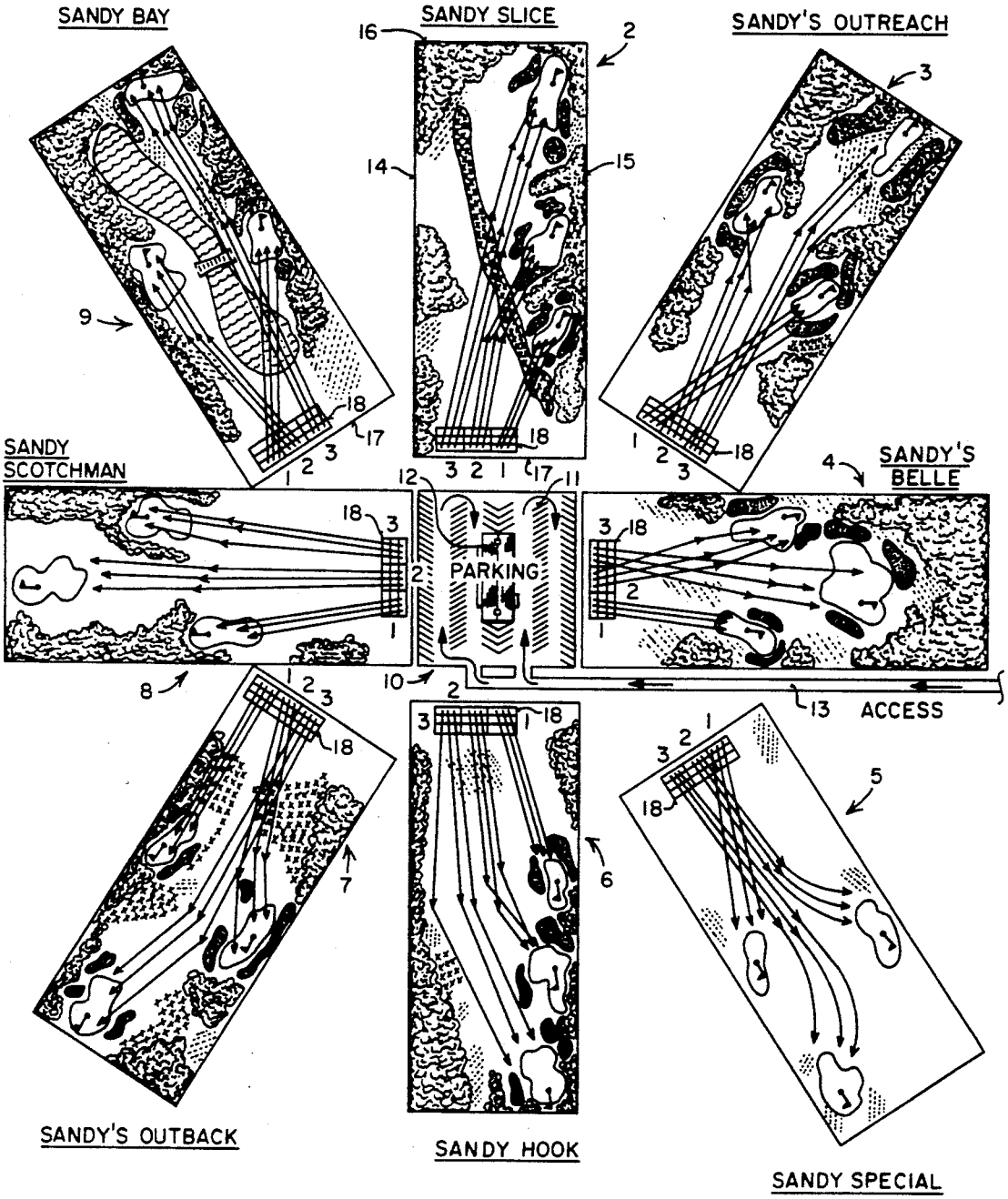
FIG. 1 is a plan view illustrating a multiplicity of courses according to my invention, associated in juxtaposition and each correlated to a central parking and clubhouse area.

Referring to FIG. 1 of the drawings, there is there illustrated eight separate yet cooperatively associated courses designated generally by the numerals 2, 3, 4, 5, 6, 7, 8 and 9, respectively. As illustrated the eight golf courses are arranged spoke-like about a central hub area designated generally by the numeral 10, which provides an area in which a parking lot 11 may be laid out surrounding amenities such as a clubhouse 12 that may house a restaurant, showers, a gymnasium, and a pro shop. To provide access to the parking lot, there is provided along the perimeter of one of the courses, here the course designated by the numeral 4 and named "Sandy's Belle", a driveway 13 that opens onto a city street or country road or highway (not shown).

It will be seen that each of the golf courses is defined by elongated and laterally spaced side edges 14 and 15 and opposite end edges 16 and 17, and that the general configuration of each of the golf courses is preferably but not necessarily rectangular. I have found that a convenient size for each of the courses is approximately 130 yards wide and 600 yards long. For visualization purposes, the width may thus be equated to approximately 1.3 times the length of the playing area of a football field, while the length may be equated to approximately six times the length of the playing area of a football field. Stated another way, each golf course encompasses approximately an area of sixteen acres. The parking and clubhouse complex, being approximately one-hundred thirty yards on a side, encompasses about 3.5 acres.

Thus, the versatility of the golf course forming the subject matter of this invention is readily apparent. A single course may be constructed in a relatively small and restricted area within a city complex, for instance, or individual courses as indicated herein may be arranged in side-by-side relationship and encompass an area of approximately one hundred twenty-eight acres, which compared to conventional golf courses, is not a large area. Alternatively, eight courses as illustrated herein may be arranged in the pattern illustrated in FIG. 1, where the open spaces between the courses, particularly toward the outer perimeter of the area encompassed by the eight courses, could be developed into a very compact residental community incorporating single family residences, or it could be dedicated to high density-type construction, such as townhouses or condominiums, thus utilizing the ambience provided by the golf course to provide a very desirable residential community in which to reside.

Referring specifically to FIG. 1, it will there be seen that within the confines or outline of each of the courses 2–9, there is located adjacent one of the end edges, preferably the end edges next adjacent the parking and clubhouse complex, a Tee area designated generally by the numeral 18. In the interest of brevity in this description, since each of the courses is provided with a Tee area 18, the same numeral is used in each of the courses to designate the Tee area. Referring with greater particularity to FIG. 2, which illustrates the course designated by the name "Sandy Slice" and the numeral 2, it will there be seen that the Tee area 18 is a quadrilateral, here shown to be generally rectangular, and is divided into a high handicap Tee area designated by the numeral 19, and designated a "green" Tee area; a second intermediate handicap Tee area designated generally by the numeral 20 and designated also as a "yellow" Tee area; and a third low handicap Tee area designated generally by the numeral 21 and also being designated as the "white" Tee area. As illustrated, the Tee areas 19, 20 and 21 are each further divided into three separate quadrants or sections, each of the sections bearing an indicia "1" or "2" or "3" as shown.

Figure 2:
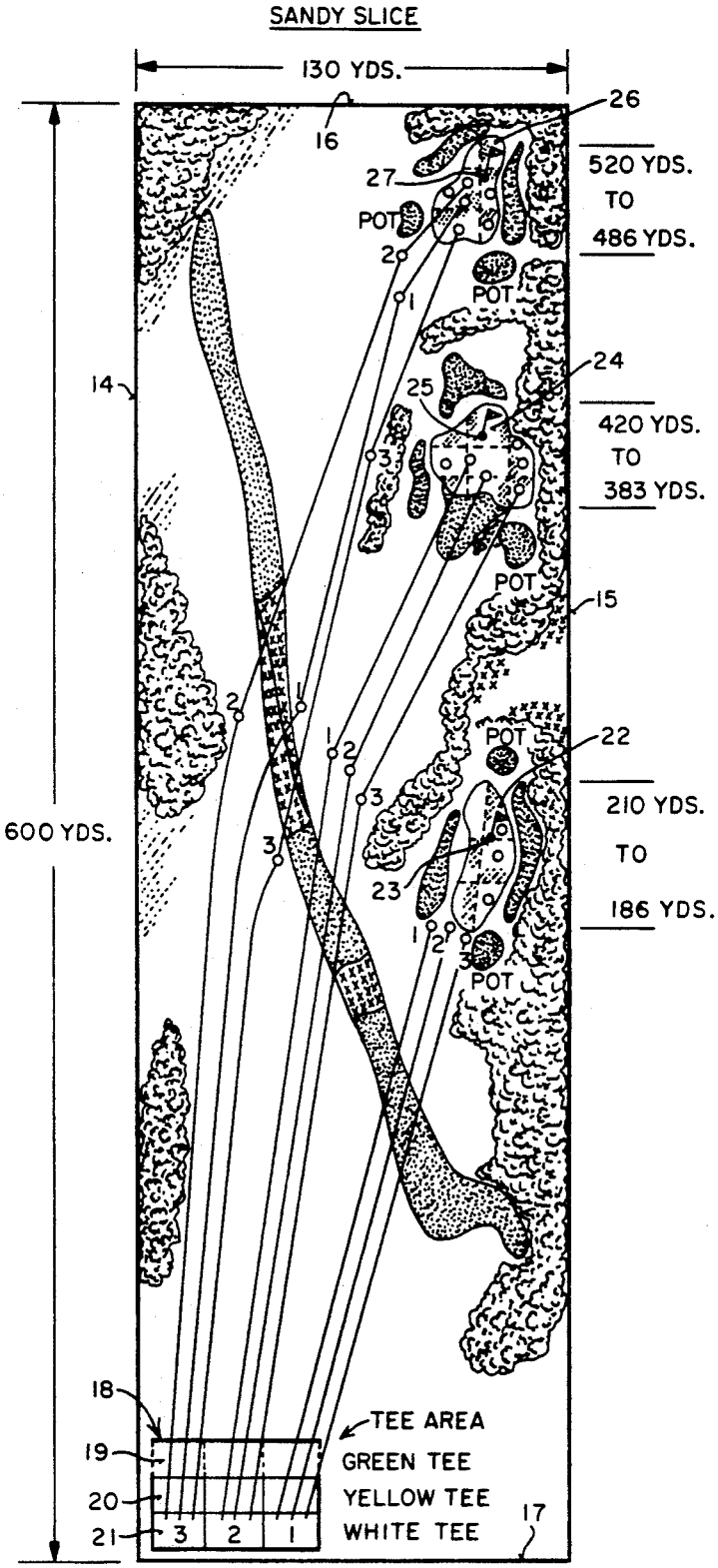
FIG. 2 is a plan view of a single one of my golf courses encompassing a common fairway of conventional length correlated to a Tee area for use in conjunction with the common fairway and three greens associated with the fairway.
Figure 2A:
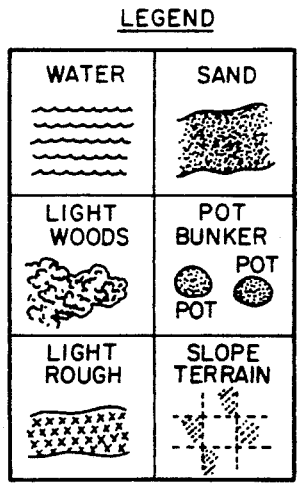
FIG. 2A is a view illustrating legends that identify the various hazards found on the course of FIG. 2.

In the embodiment illustrated in FIG. 2, the course bearing the name "Sandy Slice" indicates that this course is to be used primarily by golfers that usually "slice" the ball from the Tee area, meaning that the ball will be lofted and veer to the right as viewed in FIG. 2. That being the case, there is provided in the course 2, a first green designated generally by the numeral 22 and incorporating a "hole" or cup 23 within which is erected the customary flag to indicate the location of the cup. Since this green is located from 186 yards to approximately 210 yards from the Tee area, it is reasonable to categorize this "hole" as being a three-par hole. Additionally, since this particular course is designed to accommodate golfers that usually slice when they hit the ball, the green 22 and the cup 23 are preferably placed adjacent the right edge 15 of the course along which various types of hazards are placed or planted, such as indicated by the legend in FIG. 2A.

To play the first hole in this course, or stated in other words, to play the three-par hole 23, any one of the three areas associated with the indicia "1" and the colors white, yellow or green, may be used as a Tee-off spot. As illustrated in the drawing, if the white area "1" is utilized, the golfer requires a longer drive to reach the green. Conversely, if the green "1" area is utilized to Tee off, the golfer needs a shorter drive to reach the green. Thus, those golfers having a high handicap may utilize the shorter drive Tee area, while those golfers having a low handicap may utilize the white Tee area associated with the indicia "1".

In like manner, the second green is designated generally by the numeral 24, and encompasses the cup 25. This green is positioned approximately 383 to 420 yards from the Tee area, may be categorized as a par-4 hole and is again placed adjacent the right edge 15 of the course in order to accommodate the flight of a golf ball that has been sliced from the Tee area. Balls hit to the second green 24 are hit from the Tee off area designated by the indicia "2" in Tee area 18, and again, depending on the golfers handicap, either the white, yellow or green Tee areas may be selected.

The common fairway on course 2 entitled "Sandy Slice" includes a par-5 hole, and the green is designated generally by the numeral 26 while the cup it encompasses is designated by the numeral 27. This being the third hole to which a golfer is expected to drive one or more golf balls, this fairway and green 26 are correlated numerically with the indicia "3" in the Tee area. Again, as with the three and four-par holes 23 and 25, respectively, golfers Tee off from the white, yellow or green area associated with the indicia "3" as illustrated. To provide realism and measured degrees of difficulty to hit a ball to each of the specific greens discussed above, it will be seen that various types of hazards are provided for each of the greens. Thus, with respect to the first green and the cup 23, there is a sand trap that crosses the fairway at some distance from the Tee area, making it necessary that the golfer be able to hit the ball over the sand trap and into an area associated with one end of the green between a sand trap on the left of the green and a pot on the right side of the green. An additional sand trap flanks the green in association with the light woods along the right edge of the course as illustrated.

With respect to the second hole, or more specifically designated the cup 25 and green 24, again the fairway extends over the sand trap positioned approximately midway between the Tee area and the green, with the further hazard of a light rough area on the left constituting an extension of the elongated sand trap, and an extension of the light woods that requires that the golfer hit the golf ball along a jogged fairway in order to reach the green. Similar hazards are provided for the third hole or the cup 27, it being noted that with respect to the fairway leading to this cup, the golf ball must traverse a light rough area that is interposed in the path of flight of the ball, and which is positioned in the fairway at a distance approximating the yardage that a golfer will achieve on his Tee shot. Thus, a golfer may inadvertently hit the golf ball so that it lands in the light rough, or he may gauge the distance correctly, and hit the ball properly so as to fall beyond the light rough or fall closely in front of it, thus permitting a clear second shot along the fairway toward the third green.

As illustrated in FIG. 1, each of the courses is designed to provide different challenges for the golfer. Thus, the course designated generally by the numeral 6 and entitled "Sandy Hook" is a course designed to accommodate golfers that either conventionally hook the ball when they hit it, or who want to develop the capability of hooking a ball and thus need a course on which they can practice such hook shots. On the other hand, referring to the course designated generally by the numeral 8 and entitled "Sandy Scotchman", here the common fairway to each of the greens illustrated constitutes a generally straight path from the Tee area to each of the greens. Perhaps the most difficult course is the course designated by the numeral 9 and named "Sandy Bay" which requires very careful control of the flight of the ball because of the manner in which the common fairway to the greens is defined by the hazards illustrated.

Figure 3:
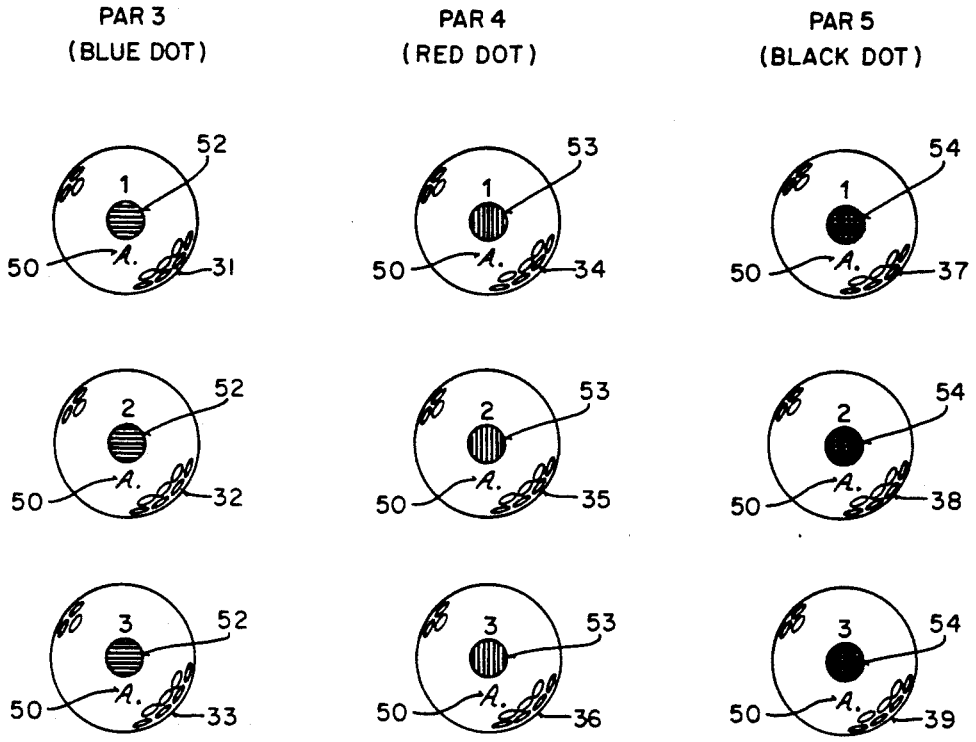
FIGS. 3 and 3A are a composite view encompassing eighteen golf balls bearing indicia indicating the owners thereof and bearing different colors to correlate a specific group of balls to the green to which each golfer is playing.
Figure 3A:
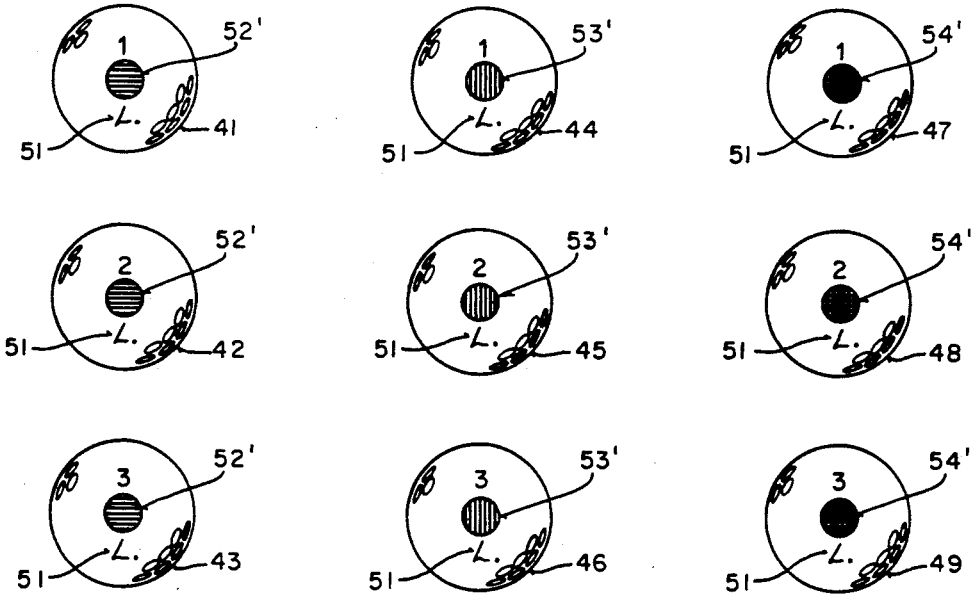

As indicated above, one of the objects of this invention is the provision of a golf course that may be played through 9 or 18 holes in a relatively short time, say an hour, for instance, even though the course being played is of conventional length. To accomplish this formidable task, a pair of hypothetical golfers named "Archie" and "Lorne" (FIGS. 3 and 3A) are each equipped with nine golf balls. Thus, for "Archie" the golf balls as illustrated in FIGS. 3 and 3A are designated by the numerals 31 through 39, while the golf balls possessed by "Lorne" are designated by the numerals 41 through 49, inclusive. With respect to the golf balls possessed by "Archie" each of his golf balls is marked with an indicia 50 that indicates possession of this set of balls by "Archie" while the balls in the possession of "Lorne" are likewise marked with an indicia 51 designating that this set of golf balls belong to "Lorne". While I have designated the balls belonging to "Archie" with a capital letter A, and the balls belonging to "Lorne" with the capital letter L, it is obvious that any selected indicia may be chosen by each of the golfers to designate ownership of his golf balls.

As illustrated in FIGS. 3 and 3A, each set of nine balls possessed by each golfer is divided into three groups designated as par-3 balls, par-4 balls, and par-5 balls. Each group of par-3 , par-4 and par-5 balls constitutes three balls, with each ball of the par-3 group of balls (31, 32 and 33) being marked with a blue area designated generally by the numeral 52 as illustrated. The group of balls 34–36 constituting the par-4 group of balls are marked with a red area 53, while the three balls 37–39 constituting the par-5 group of balls, are each marked with a black area 54. In like manner, the balls in the possession of "Lorne" are divided into par-3, par-4 and par-5 groupings, with each of the balls in the par-3 group being marked with a blue area 52', the balls in par-4 group being marked with the red area 53', while the balls constituting the par-5 group are marked with a black area 54' as illustrated. To further identify each of the balls in each of the par-3, par-4 and par-5 groupings of golf balls, the balls 31, 32 and 33 forming the par-3 group of balls for each of the hypothetical golfers, are marked with the numerals "1", "2", and "3", as illustrated. Each of the balls in each of the groups are similarly marked with indicia "1", "2", and "3", the purpose of this marking being to indicate the numerical order in which each of the balls is to be played from the Tee area 18. Thus, referring to the par-3 grouping of balls in FIG. 3 pertaining to "Archie", the number "1" ball 31 with the blue dot or color code will be the first ball to be hit from the number "1" Tee area as illustrated in FIG. 2. This ball will be hit by "Archie" toward the cup 23. In like manner, again utilizing the area bearing the indicia "1" in the Tee area 18, the number "2" ball will be hit by "Archie" and in like manner, the number "3" ball will also be hit by Archie toward the first green. Thus, all of the balls possessed by Archie and color coded with a blue dot will be hit toward the par-3 cup 23.

At this point, "Archie" having hit the three balls toward the par-3 cup 23, "Lorne" now addresses his number "1" ball, again from the white, yellow or green Tee area associated with the indicia "1" of the Tee area 18, and consecutively hits the number "2" and number "3" ball toward the par-3 cup 23. There are now six balls lying very close to the green 22 or on the green 22, three of the balls belonging to "Archie" and three of the balls belonging to "Lorne", all of the balls color coded to correlate with the green or cup to which they were played.

Now, "Archie" steps to the Tee area designated by the indicia "2", be it the white, yellow or green Tee area, and hits all of his red dot color coded balls 34, 33 and 36 down the common fairway leading to the second or par-4 cup 25. In like manner, "Lorne" steps up to the Tee area designated generally by the numeral 2 in the greater Tee area 18, and addresses his three golf balls 44, 45 and 46 bearing the red dot or area 53' down the fairway toward the par-4 cup 25. Lastly, "Archie" now steps into the box 21 bearing the indicia "3" and addresses the black dot color coded balls 37, 38 and 39 forming the par-5 group of balls and drives the balls down the fairway toward the par-5 cup 27. Then "Lorne" does the same thing with his three golf balls 47, 48 and 49, each bearing a black dot, and bearing the indicia "1", "2" and "3".

It will thus be seen that each of the golfers has hit nine balls along the common fairway leading to three different greens and cups, without leaving the Tee area 18. While I have indicated above that "Archie" and "Lorne" may alternate in hitting their respective groupings of balls, it is obvious that another method of play would be to permit "Archie" to hit all nine of his balls toward the respective greens and cups with which they are correlated through their color coding, and then permit "Lorne" to do the same with his three groups of nine color coded golf balls.

The golfers are now ready to move down the fairway to locate their respective golf balls. In the normal course, the golfers would approach the par-3 green 22 and each would look for the three golf balls color coded blue and signifying that these balls constitute golf balls hit to the par-3 green 22 and each golfer would identify his three blue dot golf balls by looking for the appropriate indicia. Each golfer in turn then would play out the first hole 23, keeping track of his strokes in the usual manner. Each golfer would then recover his golf balls marked with a blue dot and pertaining to the par-3 hole, and would progress then to the area of the fairway on which the par-4 group of balls 34–36 and 44–46 landed and would complete the play by making fairway shots of these golf balls toward the par-4 green and the cup 25. Play would continue until each golfer had sunk his group of three golf balls bearing the red dot in the cup 25, again keeping track of the strokes required to achieve this goal.

It will be noted from FIG. 2, that the group of balls 37–39 and 47–49 bearing black dots, intended to be hit toward the par-5 hole 27, might easily have landed on the fairway in and about the light rough area but in close proximity to the area where the six balls directed toward the par-4 hole might have landed. It is possible that each of the golfers, instead of immediately continuing to the par-4 hole 25 after taking their fairway shots with balls 34–36 and 44–46, may elect to take their fairway shots to the par-5 cup 27 inasmuch as they are in the vicinity of where the golf balls 37–39 and 47–49 bearing black dots landed on the fairway. If they choose to do so, they may of course play their fairway shots in whatever sequence is convenient. Whatever sequence they choose, the balls 37–39 and 47–49 pertaining to the respective golfers, and bearing the black dots for identity purposes, will now be positioned in and about the par-5 cup 27 and the golfers will advance to their respective golf balls and finish the play to the par-5 cup 27.

From the foregoing, it will be clear that the golf course forming the subject matter of this invention may be played in a novel way, using novel paraphernalia, namely golf balls pertaining to each golfer that are identified by indicia corresponding to the golfer to whom they belong, and indicia in the form of color designations that identify the particular cup and green to which each group of balls is meant to be played. Additionally, each of the balls in each group are numerically numbered with appropriate indicia, such as the numbers "1", "2" and "3" indicating the sequence in which these particular balls are to be played.

Having thus described the invention, what is believed to be new and novel and sought to be protected by Letters Patent of the United States is as follows.

I claim:

1. A golf game comprising:

at least a first golf course having first and second laterally spaced side edges and first and second generally parallel end edges defining a generally rectangular area;

a generally rectangular single tee area positioned in said golf course and adjacent said first end edge;

a plurality of laterally juxtaposed separate tee sections formed in said single tee area, each of said plurality of separate tee sections being of generally equal size and spaced equidistant from said first end edge and each of said separate tee sections further being divided into high, intermediate and low handicap tee portions, said low handicap tee portion in each said tee section being positioned adjacent said first end edge, said high handicap tee portion in each said tee section being positioned remote from said first end edge, and said intermediate handicap tee portion in each said tee section being positioned between said low and high handicap tee portions;

a fairway area in said golf course, said fairway area having golf terrain features and being traversed by a golfer playing said golf game;

a plurality of separate greens areas corresponding in number to said plurality of separate tee sections, each of said plurality of separate greens areas being separately positioned in said golf course at varying distances from said single tee area and from each other and all sharing at least a portion of said fairway area intermediate said single tee area and said plurality of separate greens areas, said plurality of separate greens areas being used with said single tee area and related thereto such that a golf shot from any one of said plurality of tee sections is directed away from the remainder of said separate greens areas, each of said plurality of separate greens areas having a putting surface and a golf ball receiving cup; and a plurality of golf balls having means for separating said plurality of golf balls into a plurality of groups of golf balls corresponding in number to said plurality of laterally juxtaposed separate tee sections and said plurality of separate greens areas, each one of said plurality of groups of golf balls having multiple balls, each of said plurality of groups of golf balls being used with its corresponding one of said plurality of separate tee sections and its corresponding one of said plurality of separate greens areas to facilitate the playing of said multiple balls in each of said plurality of groups of golf balls from each corresponding one of said plurality of separate tee sections to said corresponding one of said plurality of separate greens areas whereby a person playing said golf game utilizes said multiple balls in each of said plurality of groups of golf balls to make a plurality of golf shots to each of said plurality of greens areas from each of said plurality of tee sections in said single tee area without directing the golf balls toward any other tee section.

2. The golf course according to claim 1, in which said elongated generally rectangular area is approximately 130 yards wide and 600 yards long.

3. The golf course according to claim 1, in which said fairway is defined by selected hazards forming an intergral part of the landscaped area encompassed by the course and positioned so as to provide selected challenges to the golfer.

4. The golf course according to claim 1, wherein said course is cooperatively associated with one or more additional courses each of which includes a common fairway associated with three separate greens each incorporating a single hole or cup and a Tee area having a multiplicity of defined sections equidistant from the associated end edge of said rectangular area and each bearing indicia correlated to a predetermined green.

5. The golf course according to claim 1, in which said course is cooperatively associated with a multiplicity of additional courses arranged radially spoke-like to define a central hub area wherein corresponding end edges of said courses are cooperatively associated with each other and said hub area, said Tee areas of said courses are adjacent the end edges associated with said central hub area, and said central hub area is provided with a structure within which may be housed selected amenities such as a clubhouse, swimming pool, showers, and retail and service organizations, and a portion of said central hub area is delineated to provide automobile parking stalls.

6. The golf course according to claim 1, in which said generally rectangular tee area is positioned adjacent one of said side edges of the golf course, and said greens areas are positioned adjacent the opposite side edge of the golf course.

7. The golf course according to claim 1, in which said generally rectangular tee area is positioned generally equidistant between said side edges, and said greens areas are positioned so that two of said greens lie adjacent opposite side edges of the course and another of said greens lies intermediate the other two greens and spaced farther from said single tee area than said two of said greens.

8. The golf course according to claim 1, in which said generally rectangular tee area is positioned adjacent one of said side edges of the golf course, and said greens are positioned so that at least one of said greens is positioned adjacent the same side edge as said tee area.

9. The golf course according to claim 1, wherein said Tee area is configured as a quadrilateral and is divided into three side-by-side sections spaced progressively away from said associated end edge, each said section being identified by a different color designation, and each said section designated by a different color designation being further divided into three adjacent quadrants designated, respectively, by the numerals 1, 2 and 3.

10. A golf game comprising:

at least a first golf course having first and second laterally spaced side edges and first and second end edges defining a generally rectangular area;

a generally rectangular single tee area positioned in said golf course and adjacent said first end edge;

a plurality of laterally juxtaposed separate tee sections formed in said single tee area, each of said plurality of separate tee sections being of generally equal size and each further being divided into high, intermediate and low handicap tee portions, said low handicap tee portion in each said tee section being positioned adjacent said first end edge, said high handicap tee portion in each said tee section being positioned remote from said first end edge, and said intermediate handicap tee portion in each said tee section being positioned between said low and high handicap tee portions;

a fairway area in said golf course, said fairway area having golf terrain features and being traversed by a golfer playing said golf game;

a plurality of separate greens areas corresponding in number to said plurality of separate tee sections, each of said plurality of separate greens areas being separately positioned in said golf course at varying distances from said single tee area and all sharing at least a portion of said fairway area intermediate said single tee area and said plurality of separate greens areas, all of said plurality of greens areas being used with said single tee area, each of said plurality of greens areas having a putting surface and a golf ball receiving cup;

a plurality of golf balls having means for separating said plurality of golf balls into a plurality of groups of golf balls corresponding to said plurality of tee sections and separate greens areas, each one of said plurality of groups of golf balls having multiple balls; and means on said multiple balls in each of said plurality of groups of golf balls to correlate each of said groups of golf balls with a selected one of said plurality of separate tee segments and its corresponding one of plurality of separate greens areas, each of said plurality of groups of golf balls being used with its corresponding one of said plurality of separate tee sections and its corresponding one of said plurality of separate greens areas to facilitate the playing of said multiple balls in each of said plurality of groups of golf balls from each corresponding one of said plurality of separate tee sections to said corresponding one of said plurality of separate greens areas whereby a person playing said golf game utilizes said multiple balls in each of said plurality of groups of golf balls to make a plurality of golf shots to each of said plurality of separate greens areas from each of said plurality of separate tee sections in said single tee area.

* * * * *